US009155356B2

(12) United States Patent
Hofmann

(10) Patent No.: US 9,155,356 B2
(45) Date of Patent: Oct. 13, 2015

(54) SHOE SOLE, SHOE WITH SUCH A SHOE SOLE AND METHOD FOR THE PRODUCTION OF SUCH A SHOE SOLE

(75) Inventor: Theodor Hofmann, Schluesselfeld (DE)

(73) Assignee: PUMA SE, Herzogenaurach (DE)

( * ) Notice: Subject to any disclaimer, the term of this patent is extended or adjusted under 35 U.S.C. 154(b) by 0 days.

(21) Appl. No.: 14/379,375

(22) PCT Filed: Feb. 27, 2012

(86) PCT No.: PCT/EP2012/000829

§ 371 (c)(1),
(2), (4) Date: Aug. 18, 2014

(87) PCT Pub. No.: WO2013/127404

PCT Pub. Date: Sep. 6, 2013

(65) Prior Publication Data

US 2015/0013194 A1 Jan. 15, 2015

(51) Int. Cl.

| | |
|---|---|
| ***A43C 15/16*** | (2006.01) |
| ***A43B 13/26*** | (2006.01) |
| ***A43B 5/00*** | (2006.01) |
| ***A43B 5/02*** | (2006.01) |

(52) U.S. Cl.

CPC ..... *A43C 15/161* (2013.01); *A43B 5/001* (2013.01); *A43B 5/02* (2013.01); *A43B 13/26* (2013.01); *A43C 15/162* (2013.01); *A43C 15/164* (2013.01); *A43C 15/167* (2013.01)

(58) Field of Classification Search

CPC .... A43C 15/164; A43C 15/167; A43C 15/16; A43C 15/161; A43C 15/14; A43C 15/02; A43C 15/09; A43C 15/04; A43B 5/001; A43B 5/02

USPC ..... 36/61, 134, 127, 124, 122, 171.3, 36/171.4, 105, 116, 103, 91, 67 R, 2 A, 115

See application file for complete search history.

(56) References Cited

U.S. PATENT DOCUMENTS

| | | | | | |
|---|---|---|---|---|---|
| 767,565 | A | * | 8/1904 | Jolitz | 36/59 R |
| 830,324 | A | * | 9/1906 | Hunt | 36/61 |
| 1,093,358 | A | * | 4/1914 | Sohroeder | 36/59 R |
| 2,423,753 | A | * | 7/1947 | Brooks | 36/35 R |
| 4,561,197 | A | * | 12/1985 | Misevich | 36/127 |
| 5,377,431 | A | * | 1/1995 | Walker et al. | 36/134 |
| 5,505,012 | A | * | 4/1996 | Walker et al. | 36/134 |
| 5,617,653 | A | * | 4/1997 | Walker et al. | 36/134 |

(Continued)

FOREIGN PATENT DOCUMENTS

| | | |
|---|---|---|
| EP | 1392136 B1 | 1/2005 |
| WO | 2010101492 A1 | 9/2010 |

*Primary Examiner* — Shaun R Hurley
*Assistant Examiner* — Bao-Thieu L. Nguyen
(74) *Attorney, Agent, or Firm* — Lucas & Mercanti, LLP

(57) ABSTRACT

A shoe sole, a shoe and a method for producing a shoe sole, which has at least one cleat that is designed to make contact with the ground on the underside of the sole facing towards the ground when used as intended. In order to improve the traction of the shoe fitted with such a shoe sole the cleat has a base body that is fixed to the underside of the sole, wherein an arcuate recess having a longitudinal direction of arc is arranged in the base body which has two openings on a surface facing the ground of the base body. An insert having a shape congruent to the arcuate recess is arranged in the recess. The insert is arranged such as to be movable in the base body in the longitudinal direction of arc of the arcuate recess.

15 Claims, 5 Drawing Sheets

(56) References Cited

U.S. PATENT DOCUMENTS

| | | | | |
|---|---|---|---|---|
| 5,653,046 | A * | 8/1997 | Lawlor | 36/28 |
| 5,870,838 | A * | 2/1999 | Khayat | 36/61 |
| 6,389,714 | B1 * | 5/2002 | Mack | 36/61 |
| 7,010,871 | B2 | 3/2006 | Sussmann | |
| 8,082,686 | B2 * | 12/2011 | Campbell et al. | 36/134 |
| 8,256,145 | B2 * | 9/2012 | Baucom et al. | 36/61 |
| 8,656,610 | B2 * | 2/2014 | Baucom et al. | 36/61 |
| 8,707,585 | B2 * | 4/2014 | Dow et al. | 36/67 R |
| 2004/0159020 | A1 * | 8/2004 | Briant et al. | 36/134 |
| 2006/0021254 | A1 * | 2/2006 | Jones | 36/61 |
| 2006/0059723 | A1 * | 3/2006 | Robinson et al. | 36/127 |
| 2007/0209236 | A1 * | 9/2007 | Ishak | 36/61 |
| 2007/0251128 | A1 * | 11/2007 | Yen | 36/134 |
| 2007/0277399 | A1 * | 12/2007 | Dow et al. | 36/134 |
| 2009/0193681 | A1 * | 8/2009 | Fanetti | 36/61 |
| 2009/0235558 | A1 * | 9/2009 | Auger et al. | 36/30 R |
| 2010/0083541 | A1 * | 4/2010 | Baucom et al. | 36/25 R |
| 2010/0107450 | A1 * | 5/2010 | Locke et al. | 36/134 |
| 2010/0229427 | A1 * | 9/2010 | Campbell et al. | 36/134 |
| 2011/0197478 | A1 | 8/2011 | Baker | |
| 2011/0289798 | A1 * | 12/2011 | Jung et al. | 36/91 |
| 2012/0291315 | A1 * | 11/2012 | Baucom et al. | 36/134 |
| 2014/0310995 | A1 * | 10/2014 | Campari | 36/134 |

* cited by examiner

SHOE SOLE, SHOE WITH SUCH A SHOE SOLE AND METHOD FOR THE PRODUCTION OF SUCH A SHOE SOLE

The present application is a 371 of International application PCT/EP2012/000829, filed Feb. 27, 2012, the priority of this application is hereby claimed and this application is incorporated herein by reference.

BACKGROUND OF THE INVENTION

The invention relates to a shoe sole, which has at least one cleat that is designed to make contact with the ground on the underside of the sole facing towards the ground when used as intended. Furthermore, the invention relates to a shoe with such a sole as well as a method for the production of such a sole.

A shoe of the generic kind respectively such a shoe sole is known for example from EP 1 392 136 B1. Here, a sport shoe is described which is especially used as a soccer shoe, which comprises a plurality of cleats at the underside of the sole.

Although a cleat or cam shoe is already available with the pre-known solution by which already a positive influence of the traction behaviour of the shoe can be obtained, it has been found that a demand for improvement exist with respect to the stability during striking of the shoe on the ground. Accordingly, pre-known shoes are not yet designed in an optimal manner with respect to the grip of the shoe on the ground. This applies specifically in the case of using the sport shoe for soccer or golf, where due to the course of movement a good and slip-proof hold of the shoe on the ground is aimed for during the phases of movement.

SUMMARY OF THE INVENTION

It is the object of the invention to further develop a shoe of the generic kind respectively of its sole so that the traction of the shoe on the ground is improved, i. e. the stability of the shoe during touchdown on the ground should be improved and the grip should be enhanced. This should occur especially in such a manner that a high dynamic stability of the shoe is obtained especially during playing soccer and golf. Furthermore, an efficient and economical manner for the production of such a sole should be proposed.

The solution of this object by the invention is characterized in that the cleat comprises a base body that is fixed to the underside of the sole, wherein an arcuate recess having a longitudinal direction of arc is arranged in the base body which has two openings on a surface facing the ground of the base body, wherein an insert having a shape congruent to the arcuate recess is arranged in the recess, wherein the insert is arranged such as to be movable in the base body in the longitudinal direction of arc of the arcuate recess. The recess is designed preferably as a circular arc.

The base body can comprise an elongated shape with a longitudinal direction of cleat. The longitudinal direction of cleat can have an angle to a longitudinal direction of sole which is smaller than 35°, preferably smaller than 25° and specifically preferred smaller than 15°. By this design the effect as described later on is especially good developed.

The insert extends preferably along an angle of the arc which is between 160° and 200°, preferably between 170° and 190°.

Thereby, the insert can have an extension in longitudinal direction of arc which is so long that the insert protrudes from at least one of the openings in each position in the arcuate recess.

Furthermore, the insert can comprise a round shape, an elliptical shape or an elliptical shape with an enlargement at one end of an elliptical section in a cross section perpendicular to the longitudinal direction of arc.

It can be provided with means by which the movability of the insert is limited relatively to the arcuate recess. In the most simple case the insert comprises in the end region of its arc-shaped run a protruding section which prevents an entry of the end region in the arc-shaped recess.

The insert can consist of metal, especially of aluminium or magnesium. Alternatively, the base body and the insert can consist of plastic material, wherein the plastic materials of the base body and of the insert are different.

Also, the base body can be arranged detachably at the sole while a one-piece design with the sole is preferred.

The shoe according to the invention, especially the sport shoe, has a shoe sole of the described kind which is connected with a shoe upper part.

The shoe is preferably a soccer shoe or a golf shoe.

The method for the production of a shoe sole of the described kind provides the steps according to the invention:

a) Producing of at least one arc-shaped insert;
b) Inserting of the at least one produced insert into an injection mould for the shoe sole;
c) Injection moulding of the shoe sole including at least one base body of a cleat, wherein the at least one insert is moulded around by the plastic material of the base body so that the arcuate recess is formed in the base body.

By the proposed solution a shoe is provided which is characterized by a good and improved stability during touchdown of the shoe on the ground, compared with pre-known solutions. The grip of the shoe is improved significantly; this applies especially for the phases during a specific course of movement as it is typically for playing soccer and golf.

The arc-shaped insert according to the invention functions as a grip element which adapts itself dynamically to the running respectively rolling movement of the foot on the ground. By doing so it becomes possible to guarantee a ground contact of the shoe respectively of the sole on the ground as long as possible. This, in turn, delivers an improved grip of the shoe compared with other pre-known solutions.

This is permitted by inserting of a movable element (insert) in a cleat or also directly into the base of a sole. The insert can consist of metal, however an abrasion-resistant plastic material is preferably used which is manufactured by injection moulding. Thereby, it is important that the plastic material of the insert is not joined with the plastic material of the cleat (i. e. of the base body) respectively of the sole. Preferably, the insert is designed semi-circular and is at first produced as a component. This part it then put into a respective injection moulding tool (form of the cleat respectively form of the sole) and injection moulded with the plastic material (primarily thermoplastic polyurethane (TPU) or polyamide (PA)).

The material of the grip element is chosen—as described—in such a manner that it does not join with the cleat material (i. e. the material of the cleat base body) and thus remains movable in the longitudinal direction of the arc. The grip element can be formed in a cross section round or in other almost arbitrary shape (e. g. oval, i. e. elliptical, or also edged).

Cleats with the described insert can be provided at all envisaged cleat positions or also only at specific locations of the sole.

The enhancement of the traction results by the fact that the insert (grip element) is arranged movable forth and back along the longitudinal direction of the arc of the arcuate recess. Dependent from the contact situation between the sole and the ground the grip element can move during each stride in the arcuate (circular) recess in the cleat base body and protrude with one end more or less from the base contour of the cleat base body.

So, the traction of the shoe on the ground can be improved—especially during playing soccer and golf.

Preferably, the cleat base body is fixed permanently at the sole. But it is also possible that it is fixed exchangeably at the sole, i. e. to arrange it detachably.

In the drawing an embodiment of the invention is depicted. It shows:

DETAILED DESCRIPTION OF THE INVENTION

Figure 1:
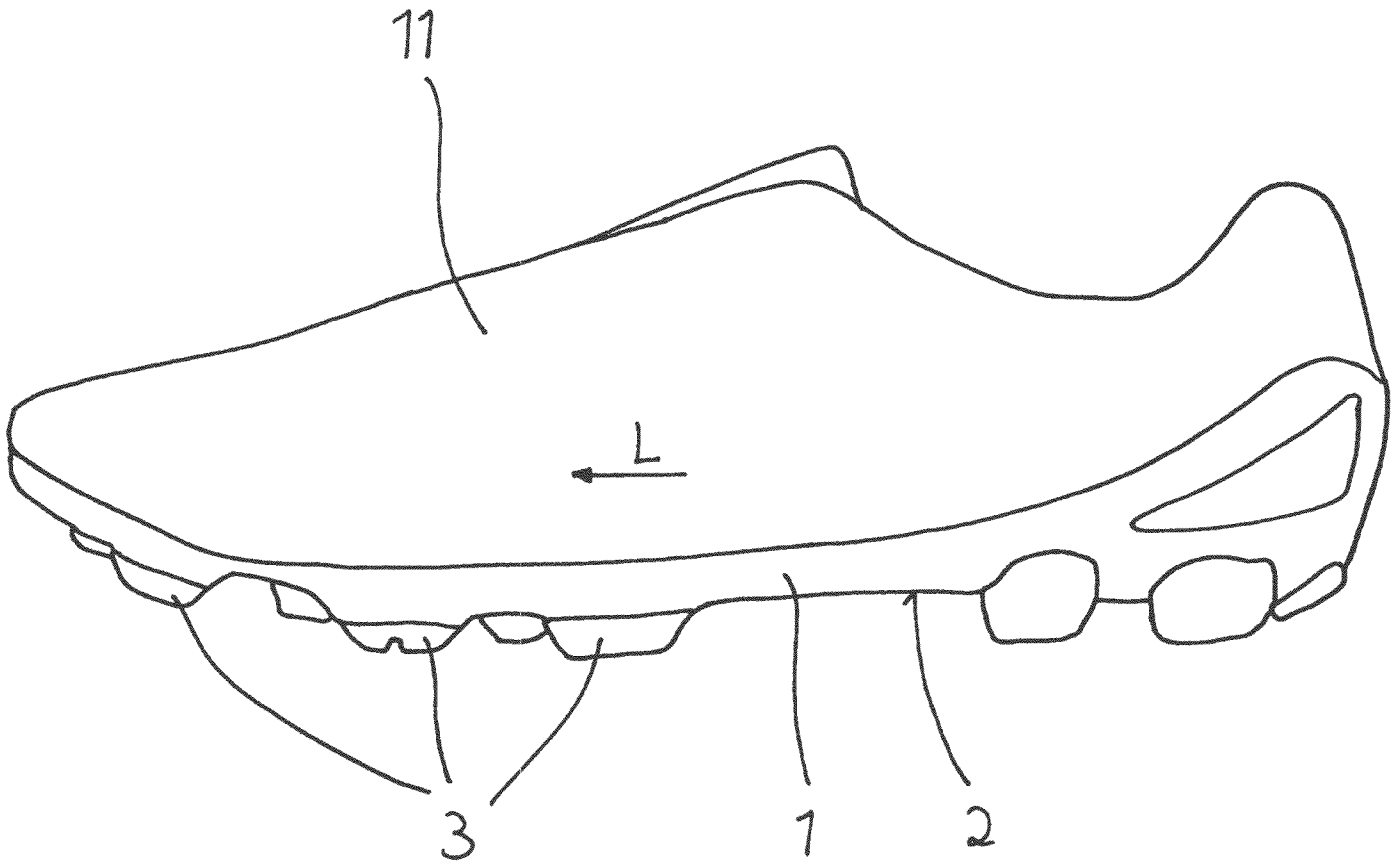
FIG. 1 the side view of a soccer shoe.

In FIG. 1 a soccer shoe is shown which has a shoe sole 1 which is connected with a shoe upper part 11 in know manner. Cleats 3 are arranged at the underside 2 of the shoe sole 1. With respect to their base body, the cleats can be formed directly by injection moulding from the material of the shoe sole 1 (respectively in the case of several materials, from which the sole consists, from the material of the outer sole); it is also possible that the cleats 3 are produced separately and are then arranged, as the case may by detachably, at the underside 2 of the shoe sole 1. The shoe respectively its shoe sole 1 has a longitudinal direction L.

Figure 2:
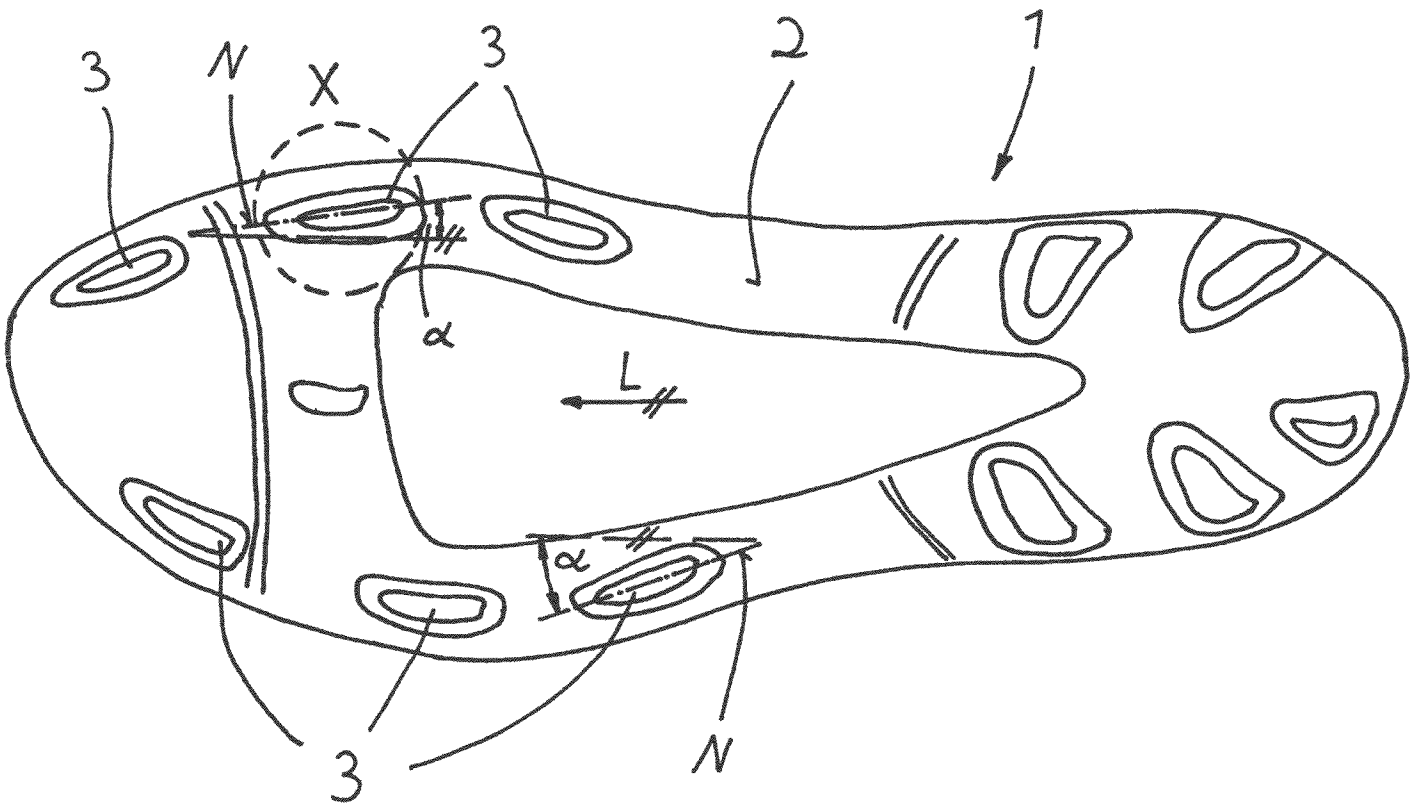
FIG. 2 the top plan view on the bottom side of the shoe, i. e. on the shoe sole, FIG. 3 the detail "X" according to FIG. 2, FIG. 4 the section A-B according to FIG. 3, wherein a cleat base body and the insert which is arranged movable in it are shown in exploded view, FIG. 5*a*, FIG. 5*b* and FIG. 5*c* three different positions of the insert in the cleat base body during a cycle of movement at which the shoe touches the ground and liftoff again and FIG. 6 the section A-B according to FIG. 3 for an alternative embodiment of the invention.

The position of the cleats 3 at the underside 2 of the shoe sole 1 is apparent again from FIG. 2 in detail. It can be seen that the elongated formed cleats 3 comprise a longitudinal direction of cleat N—at least those cleats which are arranged in the forefoot region. It can be seen that this longitudinal direction N of the cleat has an angle $\alpha$ to the longitudinal direction L of the sole. This remains mostly below 25°.

Figure 4:
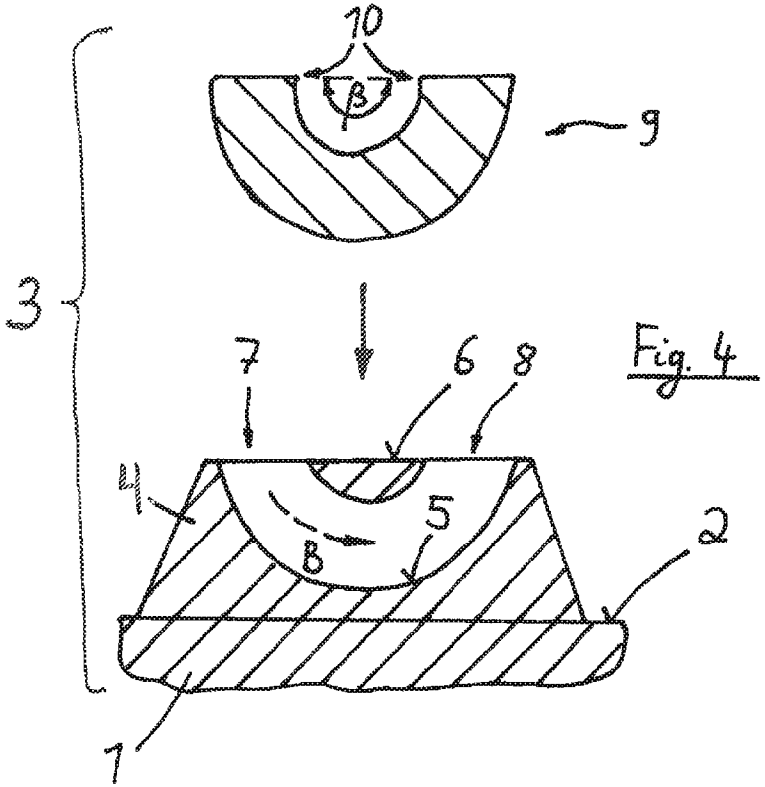
Figure 3:
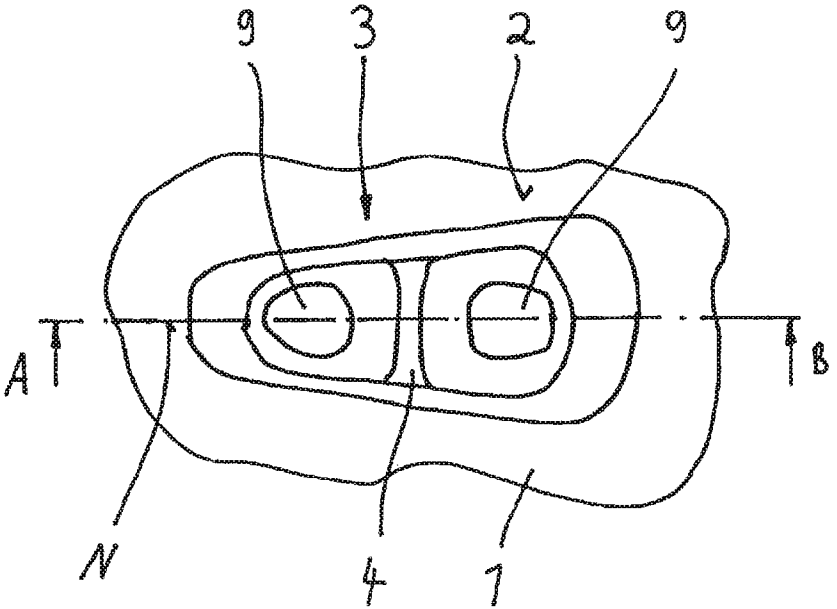

The design of the cleats 3 is apparent from FIG. 3 and FIG. 4 in detail, i. e. at least of a number of all the cleats which are arranged at the underside of the sole.

The cleat 3 consists of a base body 4 which—as already mentioned—is formed preferably from the material of the shoe sole 1 during injection moulding of the sole together with it. From FIG. 4 is can be seen that in the base body 4 a circular shaped recess 5 is machined. The recess 5 comprises a longitudinal direction B of arc. The recess 5 begins and ends at a surface 6 of the base body 4, i. e. at an area which is facing the ground during intended use of the shoe sole and contacts it (in distinction to the depiction in the figures). The recess 4 forms two openings 7 and 8 in the surface 6.

An insert 9 is arranged in the recess 5 (in FIG. 4 it can be seen in the exploded view above the base body of the cleat 4) which has an outer shape which is congruent, i. e. exactly fitting, to the shape of recess 5. The shape of the insert 9 is about that of a half of a torus which extends along an angle of the arc $\beta$ which is in the region of 180° (see upper part of FIG. 4).

The insert 9 has a bit protruding nose-shaped extensions in its both end regions which form means 10 which limit the movability of the insert 9 when it is arranged in the base body 4 of the cleat 3.

Figures 5A, 5B, 5C:
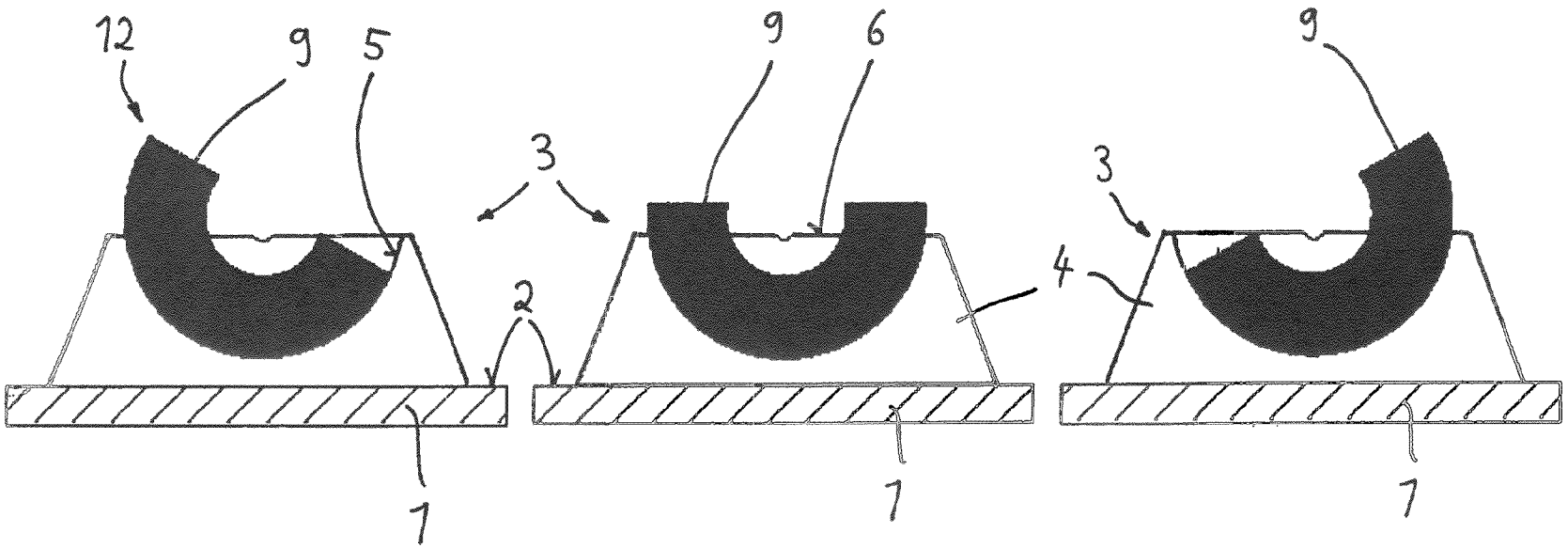

The functionality of the proposed cleat 3 is apparent from the sequence of the FIGS. 5*a*, 5*b* and 5*c*.

Prior to the contact of the shoe on the ground the insert 9 is for example in the position as shown in FIG. 5*a*. The first contact of the shoe with the ground takes place by contact of the end 12 of the insert 9 with the ground. By the force which acts during striking of the shoe on the ground the insert 9 is moved in the longitudinal direction of arc B along the recess 5, wherein an intermediate state is shown in FIG. 5*b*.

In the further course of the rolling up of the shoe on the ground the insert 9 is further moved along the recess 5 until it reaches—at lifting off from the ground—the position as shown in FIG. 5*c*. The means 10 prevent that the insert 9 can be moved beyond the maximum end positions as shown in FIGS. 5*a* and 5*c*.

Figure 6:
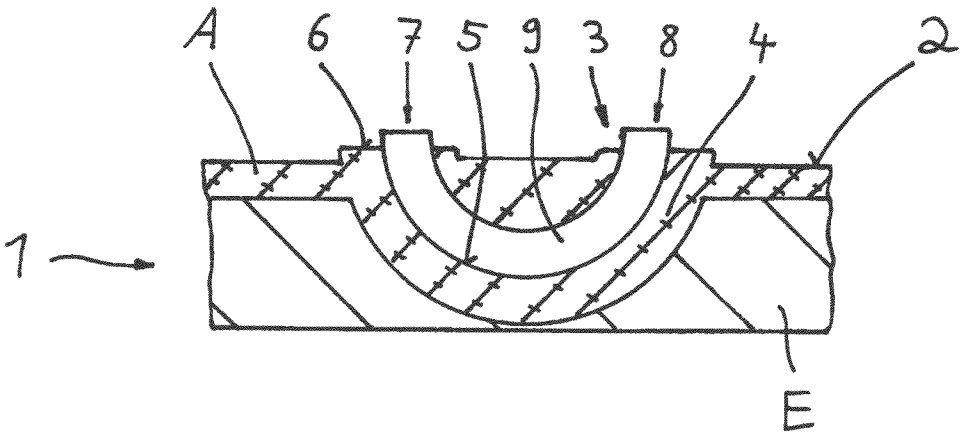

An alternative embodiment of the concept according to the invention is apparent from FIG. 6. It is a distinction to the embodiment as described above that the base body 4 is quasi formed here from the material of the sole 1 itself. This can be provided at the production of the sole 1 from a single plastic component or—as in the depicted embodiment—also in the case that the sole consists of two (several) different plastic materials. Presently, the sole 1 consist of a first component E (e. g. ethylene-vinyl acetate (EVA)) and a second (harder) component A which forms the outer sole respectively running tread. The base body 4 is here formed from the material A and forms again the arcuate recess 5 in which the insert 9 can move as described.

The described solution according to FIG. 6 is employed for example preferably for a golf shoe or for a spike sole.

Here, the projection of the surface 6 beyond the underside 2 of the sole 1 can be kept very small as the case may be and in the case of a respective demand. In the embodiment according to FIG. 6 the part of the sole material which functions as base body 4 protrudes with its surface 6 only 5 to 10 mm from the surface of the underside 2.

Due to the explained shift movement of the insert 9 in the base body 4 of the cleat 3 results accordingly an improved grip of the shoe at the ground as well as a higher stand stability of the shoe because by the insert 9 an improved catch of the shoe at the ground becomes possible.

Very beneficially, the cleat 3 is produced by the method as explained above, wherein the pre-manufactured insert 9 is placed in an injection moulding tool for the sole and is then moulded during injection of the sole so that it lies in its final assembly position. Hence, the insert 9 can be arranged respectively mounted without undercut (in spite of the means 10) in the cleat 3.

LIST OF REFERENCES

1 Shoe sole
2 Underside
3 Cleat
4 Base body
5 Arcuate recess
6 Surface
7 Opening
8 Opening
9 Insert
10 Means for limitation of movement
11 Shoe upper part
12 End B Longitudinal direction of arc
N Longitudinal direction of cleat
L Longitudinal direction of sole
α Angle
β Angle of the arc

The invention claimed is:

1. A shoe sole, which has at least one cleat that is designed to make contact with the ground on the underside of the sole facing towards the ground when used as intended, wherein the cleat comprises a base body that is fixed to the underside of the sole, wherein an arcuate recess having a longitudinal direction of arc is arranged in the base body which has two openings on a surface facing the ground of the base body, wherein an insert having a shape congruent to the arcuate recess is arranged in the recess, wherein the insert is movable in the base body, back and forth in the longitudinal direction of arc of the arcuate recess such that one end of the insert protrudes more or less from one of the two openings of the base body than the other end of the insert from the other of the two openings based on the contact situation between the sole and the ground.

2. The shoe sole according to claim 1, wherein the arcuate recess is designed as a circular arc.

3. The shoe sole according to claim 1, wherein the base body comprises an elongated shape with a longitudinal direction of cleat.

4. The shoe sole according to claim 3, wherein the longitudinal direction of cleat has an angle to a longitudinal direction of sole which is smaller than 25°.

5. The shoe sole according to claim 1, wherein the insert extends along an angle of the arc which is between 160° and 200°.

6. The shoe sole according to claim 1, wherein the insert has an extension in longitudinal direction of arc which is so long that the insert protrudes from at least one of the openings in each position in the arcuate recess.

7. The shoe sole according to claim 1, wherein the insert comprises a round shape, or an elliptical shape in a cross section perpendicular to the longitudinal direction of arc.

8. The shoe sole according to claim 1, wherein the insert is provided with means by which the movability of the insert is limited relatively to the arcuate recess.

9. The shoe sole according to claim 1, wherein the insert consists of metal.

10. The shoe sole according to claim 1, wherein the base body and the insert consists of plastic material, wherein the plastic materials of the base body and of the insert are different.

11. The shoe sole according to claim 1, wherein the base body is arranged detachably at the sole.

12. A shoe comprising a shoe sole according to claim 1, wherein and a shoe upper part is connected with the shoe sole.

13. The shoe according to claim 12, wherein the shoe is a soccer shoe.

14. The shoe according to claim 12, wherein the shoe is a golf shoe.

15. Method for the production of a shoe sole according to claim 1, wherein it comprises the steps of:

a) Producing of at least one U-shaped insert;

b) Inserting of the at least one insert into an injection mould for the shoe sole;

c) Injection moulding of the shoe sole including at least one base body of a cleat, wherein the at least one insert is moulded around by the plastic material of the base body so that the arcuate recess is formed in the base body, such that the insert is moveable back and forth in a longitudinal direction of the arcuate recess.

* * * * *